US009919771B2

(12) United States Patent
Kotrla et al.

(10) Patent No.: US 9,919,771 B2
(45) Date of Patent: Mar. 20, 2018

(54) SAFETY SYSTEM AND METHOD FOR GUIDING A DROPPED SUSPENDED LOAD AWAY FROM EQUIPMENT AND TO A SAFE LANDING AREA

(71) Applicant: Cameron International Corporation, Houston, TX (US)

(72) Inventors: Johnnie Kotrla, Katy, TX (US); James Hogan, Houston, TX (US); Ross Stevenson, Magnolia, TX (US); Jesse Garcia, Katy, TX (US)

(73) Assignee: Cameron International Corporation, Houston, TX (US)

( * ) Notice: Subject to any disclaimer, the term of this patent is extended or adjusted under 35 U.S.C. 154(b) by 18 days.

(21) Appl. No.: 14/945,094

(22) Filed: Nov. 18, 2015

(65) Prior Publication Data

US 2017/0137092 A1 May 18, 2017

(51) Int. Cl.
*E21B 7/12* (2006.01)
*E21B 19/00* (2006.01)
*B63B 22/18* (2006.01)

(52) U.S. Cl.
CPC ..... *B63B 22/18* (2013.01)

(58) Field of Classification Search
CPC ..... E21B 7/128; E21B 15/02; E21B 19/002; E21B 41/10; B63B 22/18; B63B 27/36; B63B 35/4413
See application file for complete search history.

(56) References Cited

U.S. PATENT DOCUMENTS 4,435,108 A * 3/1984 Hampton ..... E21B 7/128 175/7
4,537,533 A * 8/1985 Hampton ..... B63B 21/50 405/205
4,576,516 A * 3/1986 Denison ..... B63B 35/4413 166/367
4,643,614 A * 2/1987 Laursen ..... E21B 17/015 166/350
4,797,035 A * 1/1989 Hunter ..... E02B 17/00 405/205
8,992,127 B2 * 3/2015 Joensen ..... B63B 27/00 405/205
9,080,393 B2 * 7/2015 Wishahy ..... E21B 17/01
9,359,852 B2 * 6/2016 Kebadze ..... E21B 33/064
2008/0314598 A1 * 12/2008 Rodrigues ..... B63B 27/36 166/342
2009/0056936 A1 * 3/2009 McCoy, Jr. ..... E21B 19/002 166/250.01

* cited by examiner

*Primary Examiner* — Matthew R Buck
(74) *Attorney, Agent, or Firm* — Gable Gotwals

(57) ABSTRACT

A system and method for guiding a dropped suspended load includes a safety winch, safety buoy, and safety anchor spaced relative to one another and an offshore rig's lifting system so that the dropped load falls away from certain seabed locations and to a safe landing area. A safety winch cable runs from the safety winch to the safety buoy, and from the safety buoy to a connection to the load. The load, when in a run-away state, falls away from vertical and toward a predetermined safe landing spot on the seabed floor. The safety buoy is then used to locate the load.

13 Claims, 3 Drawing Sheets

SAFETY SYSTEM AND METHOD FOR GUIDING A DROPPED SUSPENDED LOAD AWAY FROM EQUIPMENT AND TO A SAFE LANDING AREA

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

This disclosure relates generally to safety systems and methods used in offshore oil and gas drilling. More specifically, the disclosure relates to safety systems and methods used in the offshore drilling environment to prevent a suspended load from causing damage to sub-sea equipment when the lifting system fails.

Dropping a large suspended load from a rig while operating over existing installed subsea infrastructure can be catastrophic. To minimize the adverse effects of such an accident, a need exists for a system that guides the dropped or run-away load away from specific seabed locations and to a safe landing area.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims According to some embodiments of a safety system for guiding a dropped or run-away suspended load, the safety system includes:

- a safety winch arranged at a predetermined horizontal distance from a lifting system of an offshore rig, the safety winch having a safety winch cable arranged for connection to a load to be lifted or lowered by the rig's lifting system;
- a safety buoy located in water surrounding the perimeter of the offshore rig and arranged at a predetermined horizontal distance from the safety winch, the safety buoy having means for receiving a portion of the safety winch cable; and
- a safety buoy anchor arranged on the seabed at a predetermined horizontal distance from the safety buoy, the safety buoy anchor having a safety buoy cable connected to the safety buoy.

Embodiments of a method for guiding a dropped or run-away suspended load along a predetermined guide path include

- routing a safety cable from a safety winch located on a drilling rig to an anchored safety buoy located in a body of water surrounding a perimeter of the drilling rig, and from the anchored safety buoy to a load to be suspended from a lifting system of the drilling rig; and
- connecting one end of the safety winch cable to the suspended load.

The location of the safety winch relative to the rig's lifting system, and the location of the safety buoy relative to the safety winch, can be tailored to guide the trajectory of the run-away load along a pre-determined path to the safest direction from the rig.

BRIEF DESCRIPTION OF THE DRAWINGS

The subject disclosure is further described in the following detailed description, and the accompanying drawing and schematic of non-limiting embodiment of the subject disclosure. The features depicted in the figure are not necessarily shown to scale. Certain features of the embodiments may be shown exaggerated in scale or in somewhat schematic form, and some details of elements may not be shown in the interest of clarity and conciseness.

ELEMENTS AND NUMBERING USED IN THE DRAWINGS

Figure 1:
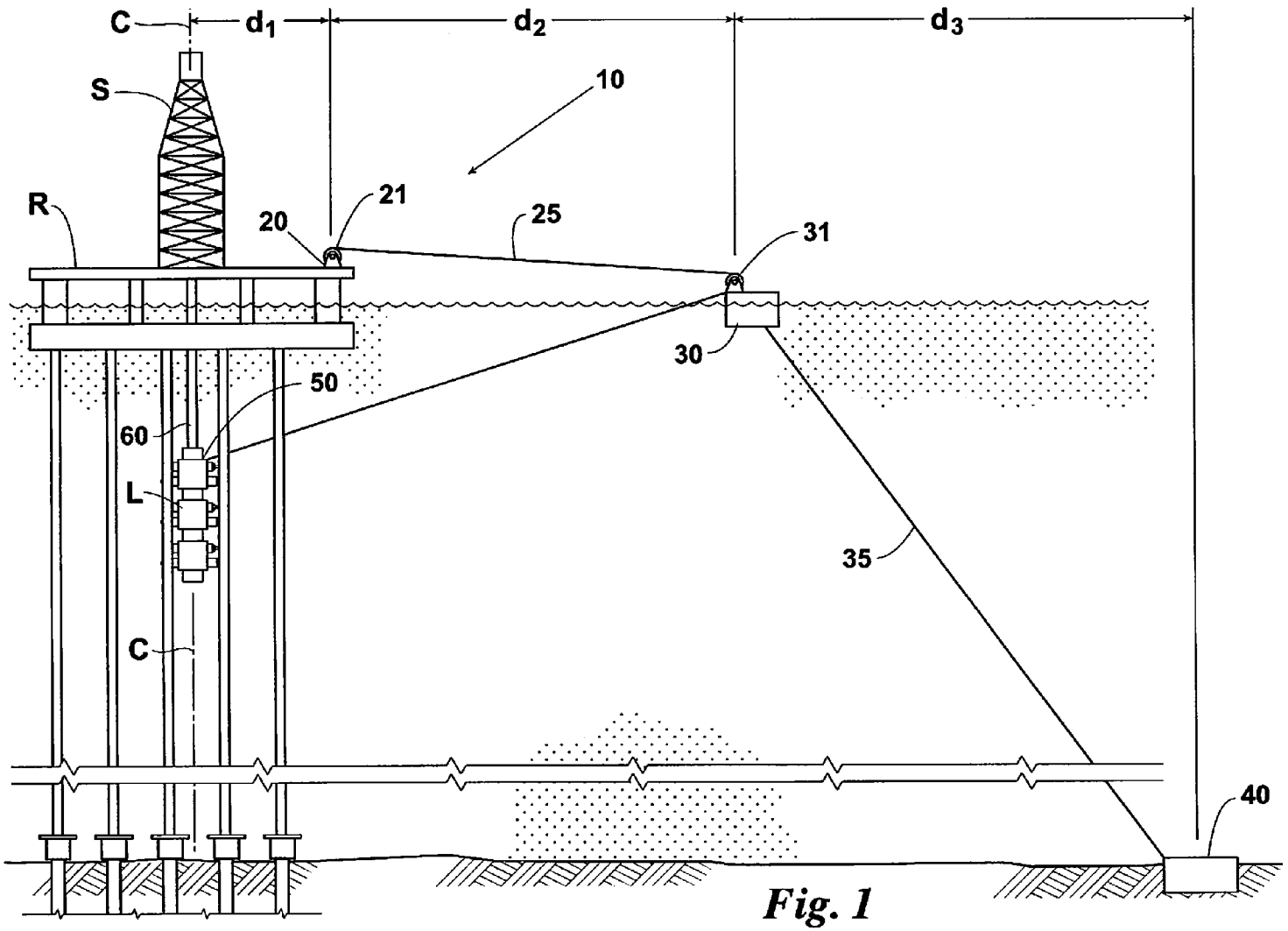
FIG. 1 is a schematic of a preferred embodiment of a dropped object safety system. The size of the safety equipment, locations, distances, and water depth are dependent on specific deployed site conditions.
Figure 2:
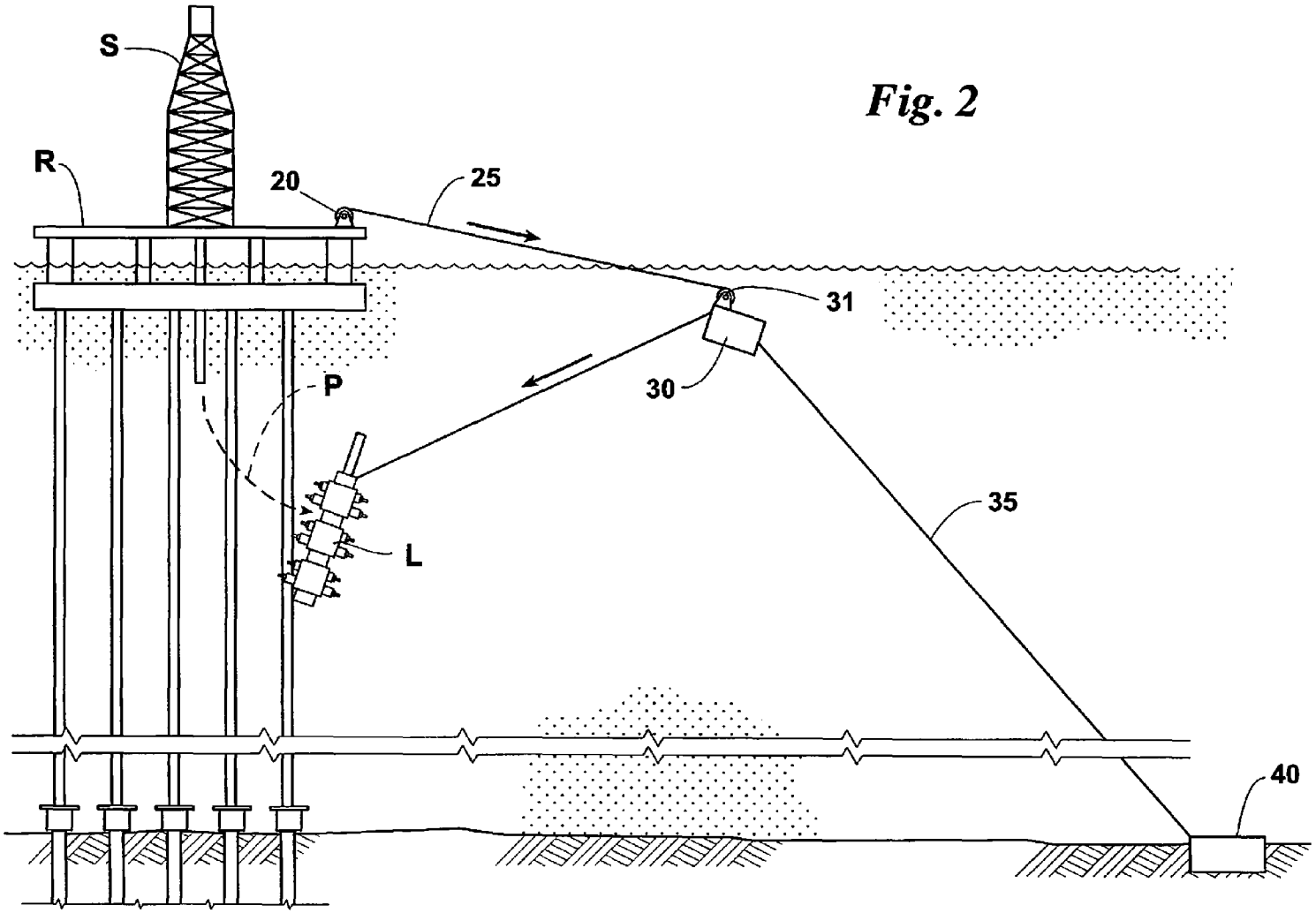
FIG. 2 is a schematic illustrating a dropped object being guided away from an offshore rig along a pre-determined trajectory to guide the object away from specific seabed locations and to a safe landing area.
Figure 3:
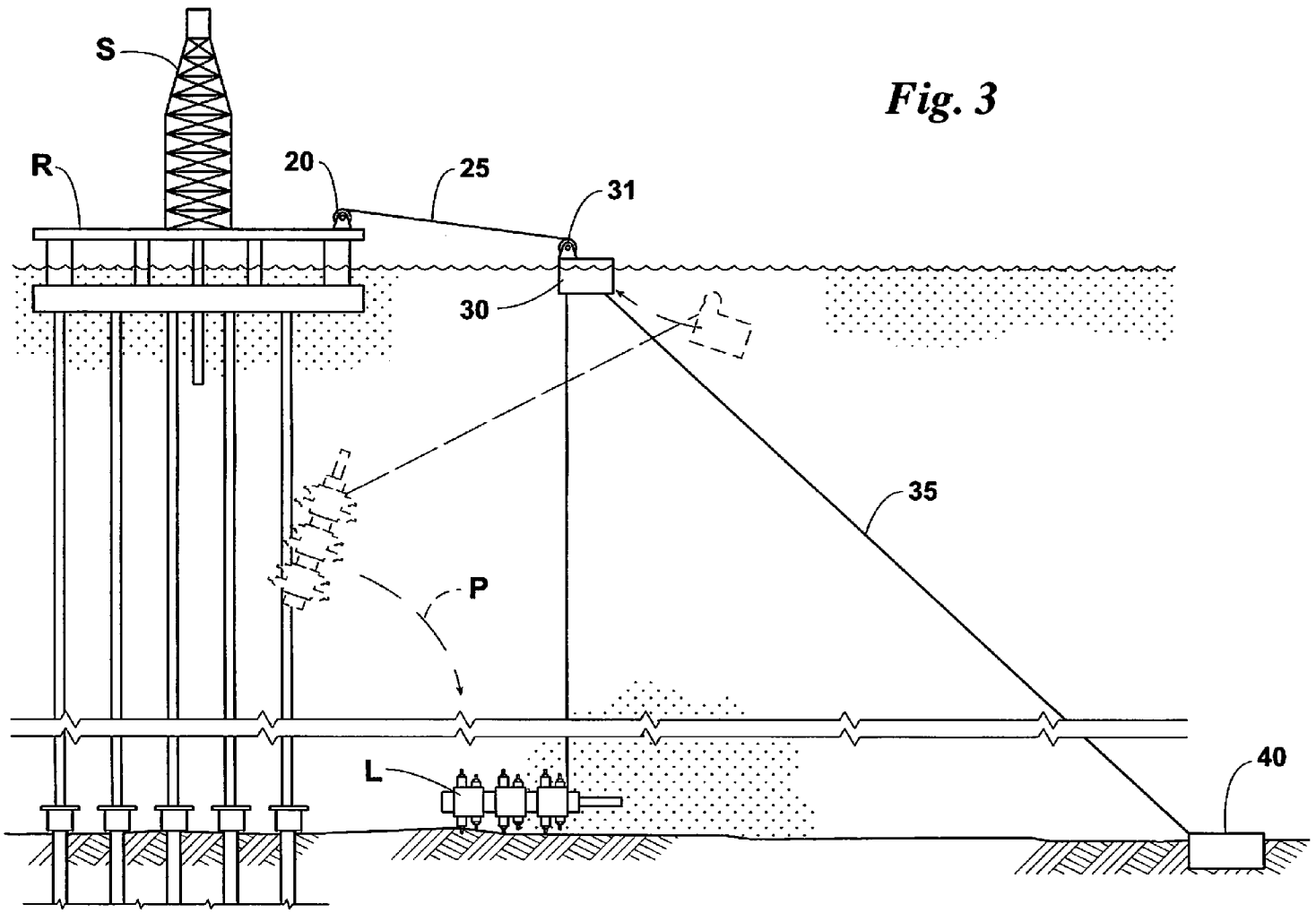
FIG. 3 is a schematic illustrating the safety system after the dropped object has come to rest on the seabed.

10 Safety system
20 Safety winch
21 Means for receiving 25 such as a spool or drum
25 Safety winch line or cable
30 Safety buoy
31 Means for receiving a portion of cable 25 such as a spool or drum
35 Safety buoy line or cable
40 Safety buoy anchor
50 Cable connection of load to be lifted or lowered
60 Steel cable or drilling line of drawworks or lifting/lowering system S
C Vertical centerline of the drawworks or lifting/lowering system S steel cable or drilling line 60
L Load to be lifted or lowered by the drawworks or lifting/lowering system S
P Arcuate-shaped path for run-away load L provided by system 10
R Offshore rig
S Offshore rig's drawworks or lifting/lowering system S
d1 Horizontal distance between drawworks' line 60 and safety winch 20
d2 Horizontal distance between safety winch 20 and safety buoy 30
d3 Horizontal distance between safety buoy 30 and safety anchor 40

DETAILED DESCRIPTION

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Referring to the drawing figures, an embodiment of a safety system 10 includes a safety winch 20 located on an offshore rig "R", a safety buoy 30, and a safety buoy anchor 40. A safety winch line or cable 25 stored on the safety winch's spool 21 is routed through a spool 31 of the safety buoy 30 and then at a downward oblique angle to a cable connection 50 of the suspended load "L" which is to be lowered by the rig's drawworks winch (or other heavy lifting system) "S" and its associated steel cable or drilling line 60. The buoy 30 helps provide a mechanical advantage to the cable 25 and its spool 31 serves as a kind of head pulley for the cable 25, changing a direction of the cable 25 toward the load L. A safety buoy line or cable 35 connects the safety buoy 30 to the safety buoy anchor 40 located on the seabed.

The safety winch's cable 25 is allowed to "pay out" when the suspended load L is being actively lowered by the rig's lifting system S. If anything in the rig's lifting system S fails, breaks, or otherwise can no longer support the load L, the safety winch 20 is arranged to lock using winch means well known in the art, or optionally set to pay-out slowly (again using winch means well known in the art), thereby utilizing the buoyancy of the safety buoy 30 to guide the run-away load L to a relatively safe landing area on the seabed. Safety buoy 30 is a water tight and submergible buoy, having a size or buoyancy force appropriate for submerging when subjected to the run-away load L (and then resurfacing).

The safety winch 20 can be synchronized to freely pay out cable 25 as the lifting system S lowers the load L, and then offer resistance when the lifting system S stops. A similar scenario could operate during a lifting operation. Or, the winch 20 could simply have its brake applied slightly all the time (comparable to the "drag" setting on a fishing reel). Once the load L is in position or properly secured at its final destination, additional cable 25 can be paid out to release tension on the line and a remote operated vehicle (not shown) can be used to detach cable 25 or the line's fastener from the load L. The cable 25 can then be retrieved and, if needed, secured to the next load L to be lowered (or lifted).

Rather than the run-away load L dropping vertically downward from the lifting system S, the load L swings away and follows an arcuate path "P". The stopped or slowed pay-out of the rig's safety winch 20 causes the safety buoy 30 to submerge until the run-away load L comes to rest on the seabed, at which time the safety winch 20 can continue to pay-out cable 25 until the buoy 30 re-surfaces, giving an approximate location of the dropped load L on the seabed. The winch 20 can then be used to assist in retrieving the dropped load L.

To lower load L, a steel cable or drilling line 60 of the lifting system L is connected to the load L. Safety winch 20 is positioned at a predetermined horizontal distance "$d_1$" from the line 60, indicated by a vertical centerline "C" of the lifting system S. Preferably the winch 20 is located toward the perimeter of the rig R. Safety buoy 30 is then positioned at a predetermined horizontal distance "$d_2$" from the safety winch 20. Similarly, safety buoy anchor 40 is positioned a predetermined horizontal distance "$d_3$" from the buoy 30. The location of the safety winch 20, safety buoy 30, and buoy anchor 40 can be tailored to guide the trajectory of the run-away load along a pre-determined path P in the safest direction away from the rig R.

While system 10 does not prevent an accident while running heavy payloads to the seabed, it may avoid damaging equipment located on the seabed below the rig R and may minimize the damage such an accident causes to the dropped payload.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

What is claimed:

1. A system comprising:

a safety winch located on a drilling platform and including a safety winch cable;

a safety buoy located in a body of water surrounding the drilling platform and including a cable spool;

a safety buoy anchor located on a seabed of the body of water and including a safety buoy cable connecting the safety buoy to the safety buoy anchor;

the safety winch cable running from the safety winch to the cable spool of the safety buoy and from the cable spool to a load to be lifted or lowered by a lifting system of the drilling platform different than that of the safety winch.

2. A system according to claim 1 further comprising a spacing between the safety buoy and the load being selected to provide a predetermined glide path for the load if the lifting system fails.

3. A system according to claim 1 further comprising a payout of the safety winch cable being in a synchronized relationship to a payout of the lifting system.

4. A system according to claim 1 further comprising the safety buoy being a water tight submergible safety buoy.

5. A system comprising:

a safety winch arranged at a horizontal distance $d_1$ from a lifting system and having a safety winch cable;

a safety buoy arranged at a horizontal distance $d_2$ from the safety winch and having means for changing a direction of the safety winch cable away from the safety buoy and toward a load to be lifted or lowered by the lifting system; and a safety buoy anchor arranged at a horizontal distance $d_3$ from the safety buoy and connected to the safety buoy by a safety buoy cable;

the safety winch cable when in use running from the safety winch to the safety buoy and from the safety buoy to the load.

6. A system according to claim 5 further comprising the horizontal distance $d_2$ being a distance that provides a predetermined guide path of the load away from a vertical centerline of the lifting system when the load is in a dropped state.

7. A system according to claim 5 further comprising a payout of the safety winch cable being in a synchronized relationship to a payout of the lifting system.

8. A system according to claim 5 further comprising the safety buoy being a water tight submergible safety buoy.

9. A method for guiding a suspended load along a predetermined subsea guide path, the method including:

routing a safety winch cable from a safety winch located on a drilling rig to a cable spool of safety buoy located in a body of water surrounding a perimeter of the drilling rig, and from the safety buoy to connection to a load to be suspended from a lifting system of the drilling rig different than that of the safety winch, wherein the safety buoy is anchored by a safety buoy anchor located on a seabed of the body of water.

10. A method according to claim 9 further comprising paying out the safety winch cable as the load is being lowered by the lifting system.

11. A method according to claim 10 further comprising synchronizing the paying out with that of the lifting system.

12. A method according to claim 9 further comprising braking a payout of the safety winch cable.

13. A method according to claim 9 further comprising using the safety buoy to locate the load when in a run-away state after being dropped by the lifting system.

* * * * *